US005140876A

United States Patent [19]

Fields

[11] Patent Number: 5,140,876

[45] Date of Patent: Aug. 25, 1992

[54] VARIABLE-FULCRUM PLIERS

[76] Inventor: Walter G. Fields, 19 Village La., Middletown, N.J. 07748

[21] Appl. No.: 844,550

[22] Filed: Mar. 2, 1992

[51] Int. Cl.[5] ..... B25B 7/04

[52] U.S. Cl. ..... 81/408; 81/405

[58] Field of Search ..... 81/407, 405, 409.5, 81/408, 385, 319, 320, 321, 322, 331

[56] References Cited

U.S. PATENT DOCUMENTS

| | | | |
|---|---|---|---|
| 1,565,210 | 12/1925 | Seiber | 81/409.5 |
| 1,639,183 | 8/1927 | Ingram | 81/411 |
| 1,763,527 | 6/1930 | Jones | 81/412 |
| 3,232,152 | 2/1966 | Miller | 81/408 |

*Primary Examiner*—Bruce M. Kisliuk
*Assistant Examiner*—Lawrence Cruz
*Attorney, Agent, or Firm*—Charles F. Gunderson

[57] ABSTRACT

A pair of pliers has two opposingly curved halves to form jaws on one end and handles on the other end. One of the halves includes a primary, fised pivot blot, and a secondary, fixed pivot lug, adjacent to the pivot bolt. The other half has an opening in the pivot area with a recess on one side to hold the fixed pivot; the other side being arced about the recess and adjacent to, but just clearing the pivot lug. A spring on the other half holds the fixed pivot in the recess for basic opening and closing of the jaws of the pliers, but when the jaws engage a solid object, the fixed pivot comes out of its recess, and the pivot lug, which is toothed, engages the adjacent portion of the arced side of the opening, which is also toothed, to shift the fulcrum of the pliers from the fixed pivot on the one side of the opening to the pivot lug on the other side. The orientation of the arc along the other side, and the relative position of the pivot lug may improve the mechanical advantage and the effectiveness of the pliers.

5 Claims, 1 Drawing Sheet

VARIABLE-FULCRUM PLIERS

BACKGROUND OF THE INVENTION

Pliers are one of the most common and valuable of all tools, and there are inumerable varieties of pliers; from gas pliers to needle-nose, diagonal pliers, and many special-purpose designs. Pliers, generally, have two separate halves, hinged on a single pivot with hand portions on one side of the pivot compressing jaw portions on the other side of the pivot. Some have locking devices, and approach the functions of wrenches, but almost all are controlled by opposing hand grips on a pair of handles. All are useful in their ways and for their special purposes.

It is an object of this invention to provide a pair of pliers that can open and close in a normal manner, about a first, fixed pivot pivot or fulcrum, but, when it seizes on a given object, it can, automatically, shift from its first, fixed fulcrum to a second, variable fulcrum at a more advantageous location for the application of pressure on and control of the given object.

It is a further object of this invention to provide a pair of pliers that can open and close in a normal manner, but, when the jaws of the pliers engage a desired object, it can, automatically, shift its fulcrum to a location closer to the object, and lock the fulcrum in that position to increase the mechanical advantage substantially and to provide a much harder grip on the object.

SUMMARY OF THE INVENTION

A pair of pliers has two pivotable halves, each with a jaw element and a handle portion on opposing sides of a pivot. One of the halves includes a primary, fixed pivot bolt, and a secondary, rigid, pivot lug spaced from the primary fixed pivot bolt. The other of the halves includes an open portion with one side fitted to accommodate and pivot about the primary fixed pivot bolt, in a first position. The other side of the open portion rotates freely adjacent to the secondary pivot lug. The other side of the open portion has teeth to engage teeth on the adjacent side of the secondary pivot lug when the primary, fixed pivot bolt is displaced from its first position within the open portion. The primary, fixed pivot bolt acts as a fulcrum as the halves of the pliers are opened and closed, but when an object is positioned between the jaws of the pliers, and the handle portions continue to be compressed, the object, momentarily, becomes the fulcrum, and the fixed pivot is displaced from its first position within the open portion, and the toothed side of the secondary, fixed pivot lug engages the adjacent sector of the toothed side of the open portion to become a secondary pivot and fulcrum for the compression of the jaws on and the control of the object. When the secondary, fixed pivot lug is positioned closer to the jaws and to the object, the mechanical advantage, and the pressure on the object is increased considerably.

DETAILED DESCRIPTIONS OF THE DRAWINGS

Figures 1A, 1B, 1C, 1D, 1E, 1F, 2A, 2B, 2C, 2D, 2E, 2F:
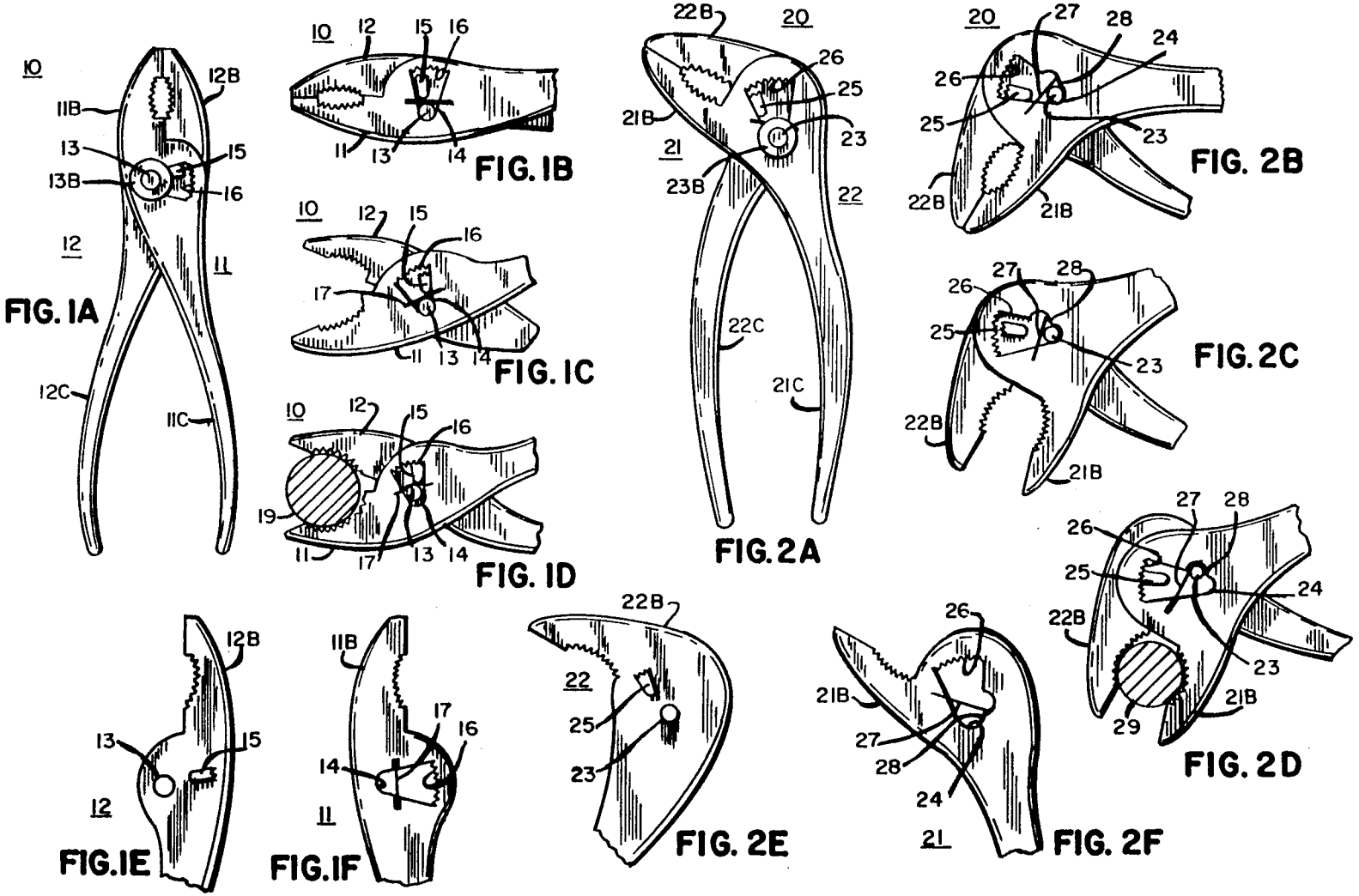
FIG. 1A is a side view of one species of the invention in a closed position.
FIG. 1B is a side view of a portion of this species in its closed position.
FIG. 1C is a side view of the portion of this species in an open position.
FIG. 1D is a side view of the portion of this species engaging an object with the fulcrum shifted from the fixed pivot to a rigid lug.
FIG. 1E is a side view of the one half of the pair showing the fixed pivot and the rigid lug.
FIG. 1F is a side view of the other half of the pair showing an opening with opposing sides.
FIG. 2A is a side view of another species of this invention in a closed position.
FIG. 2B is a side view of a portion of this species in its closed position.
FIG. 2C is a side view of the portion of this species in an open position.
FIG. 2D is a side view of the portion of this species engaging an object with the fulcrum shifted from the fixed pivot to a rigid lug.
FIG. 2E is a side view of the one half of the pair showing the fixed pivot and rigid lug.
FIG. 2F is a side view of the other half of the pair showing an opening with its opposing sides.

Referring now more particularly to FIG. 1A, a side view of one species 10 of the invention is shown in a closed condition. This includes one half 12, and another half 11. The one half 12, seen more clearly in FIG. 1E, has a jaw portion 12B and a handle portion 12C. A fixed pivot 13 has a nut 13B to secure the two halves together in a pivotable manner. A pivot lug 15 has teeth to engage the teeth along 16, in operation, in a manner to be described and shown in subsequent figures, such as 1D.

FIG. 1B shows a side view of a part of the device of the same species, in a closed condition, with the nut 13B removed to show the structure and functions of the pivots and an open portion. The same elements here, and in all of the figures, are similarly numbered. This clearly shows the primary, fixed pivot 13 seated in a recess 14 in one end or side, of the open portion. This also shows a spring that holds the pivot 13 in the recess 14. The fixed pivot lug 15 is seen adjacent to—but not touching—the row of teeth along 16 on the other end, or side, of the open portion.

FIG. 1C shows a side view of a part of the device of the same species, as in FIG. 1B, in an open position, ready to engage any suitable object. The fixed pivot lug 15 is now further along the row of teeth 16, but still not touching them, since the spring 17 holds the pivot 13 within the recess 14.

FIG. 1D shows a side view of a part of the device of the same species, as in FIG. 1C, in operation and engaging an object 19 in its jaws. Actually, when the jaws meet a solid object, the jaws become the fulcrum, and pressure is applied to the fixed pivot 13 as the no load fulcrum. This presses the fixed pivot 13 against the spring 17 to bend it and allow the fixed pivot lug 15 to be pushed towards the other side of the open portion, until its teeth engage the teeth 16 of the adjacent portion, and lock into that position. As more pressure is applied to the handle, the newly-positioned fixed pivot lug 15 now acts as the fulcrum of the pliers, for whatever additional pressure may be applied to the handle portions of the pliers.

FIG. 1E is another side view of a part of the device of this species, in a slightly larger scale, to show, more clearly, the one half of the device 12, with its fixed pivot 13 and the fixed pivot lug 15 with its teeth that engage the teeth on the other side of the open portion. In this species, a space between the two is necessary to accommodate the spring 17.

FIG. 1F is another side view, as in FIG. 1E, to show the other half 11 of the device, with its open portion having a pivot recess 14 at one side, and the row of teeth 16 at the other side. This also shows the spring 17 positioned to hold the pivot 13 within the recess 14 as long as there is no pressure against the jaws.

FIG. 2A shows a side view of another species 20 of this invention in a closed position. The one half of the device is now 22 and the other half of the device is 21. The rigid pivot lug 25 is now positioned closer to the jaws of the device, and, generally, between the fixed pivot and the jaws.

In all of the FIGS. 2A through 2F, similar elements are, again, similarly numbered.

In these figures, the device 20 has the two halves 21 and 22, with jaw portions 21B and 22B, and handle portions 21C and 22C. A fixed pivot is now 23, with a securing nut 23B. The fixed pivot lug is now 25, and is positioned adjacent to, but clear of a row of teeth 26. Another spring 27, seen in subsequent figures, holds the fixed pivot 23 in its recess until the jaws engage an object.

In this species, the motion of the fixed pivot 23 is no longer perpendicular to the axis of the device, so another mechanism must be adapted to move the rigid pivot lug 25 toward the teeth 26. This is accomplished by a slope 28, also seen in subsequent figures, that urges the lug 25 toward the other side 26 of an open portion when an object 29 increases the pressure against the fixed pivot. Actually, the slope is in two stages. The first moves the fixed pivot forward to engage 25 in the adjacent portion of the teeth 26, but a slight plateau holds the lug in its new position in case more motion of the fixed pivot is necessary.

As in the earlier sketches, FIG. 2B shows a side view of a part of this species with the securing nut 23B removed from the fixed pivot bolt, to show the structure and function of the pivots and the open portion. This now shows the spring 27 that urges the pivot 23 against the one side 24 of the opening. FIG. 2B is, again, in a closed position.

FIG. 2C shows a side view with the pliers, pivoting on the fixed pivot, in a semi-open position.

FIG. 2D shows the side view, as in FIG. 2C, with the pliers, in operation, engaging an object 29 to put pressure on the fixed pivot to move the fixed pivot 23 up the ramp to the plateau 28, to urge the teeth of the pivot lug 25 into the adjacent portion of the teeth 26 along the other side of the opening. The fixed pivot 23 can move along the ramp 28 with the pivot lug 25 locked in its present position until the handles are reopened, and the spring 27 pushes the pivot 23 back into the bottom of the recess of 24.

FIG. 2E is another side view, slightly enlarged, of a part of this species, to show, more clearly the one half 22 with its fixed pivot 23, and its pivot lug 25.

FIG. 2F is another side view, as in FIG. 2E, to show, more clearly, the other half 21 with its open portion including the recess 24 at one side, and the toothed row 26, along the other side. The slope and plateau 28 show how the pivot lugs will be urged forward and secured. The spring 27 shows how the pivot 23 can be held in the bottom of its recess 24 until it is displaced, and returned to its recess when the pressure is removed.

The operation of both species of these pairs of variable-fulcrum pliers should be fairly clear from the sequence of drawings. The two jaws of the pliers hinge about the fixed pivot 13 or 23 that is held, by a spring, 17 or 27, in a recess, 14 or 24, until the jaws engage an object, such as 19 or 29. As the handles continue to be depressed, the fulcrum, momentarily shifts to the jaws of the pliers, forcing the fixed pivot against the spring, 17 or 27 to move the fixed pivot out of its recess and to engage the teeth of the pivot lug, 15 or 25, against the corresponding section of the teeth, 16 or 26, on the opposing side of the opening. This provides the new, final, fulcrum to apply increased pressure on the object to accomplish the function of the pliers.

While typical embodiments of this invention are shown to illustrate the basic concepts of this invention, many variations of this concept will be obvious to one skilled in the art. The position of the fixed pivot, as well as the position of the pivot lug may be varied, along with the lengths of the jaws and the handles.

The conformation of the jaws and the handles can also be varied to accommodate specific objects, and perform varying functions.

I claim:

1. A pair of pliers having a first half and a second half, each with a jaw portion and a handle portion; a first, fixed pivot bolt, projecting from said first half between said jaw portion and said handle portion, and extending through a pivotal opening between said jaw portion and said handle portion of said second half, for connecting, and providing a pivot between said first and second halves of said pliers, and allowing said handle portions to control the motion of said jaw portions; said pivotal opening in said second half having a recess on one side to accommodate said first, fixed pivot bolt; the other side of said opening having a portion describing an arc about said recess, spaced a given distance from said recess; a secondary pivot lug, spaced less than said given distance from said fixed pivot bolt, projecting from said first half within said pivotal opening, adjacent to, but not engaging said arced portion of said other side; spring means within said pivotal opening on said second half urging said pivot bolt into said recess; said pliers opening and closing freely about said first, fixed pivot bolt until said jaws engage a solid object, whereat said fixed pivot bolt leaves its recess and said secondary pivot lug engages the adjacent sector of said arced portion of said other side; whereby the fulcrum of said pliers shifts from said first, fixed pivot bolt to said secondary pivot lug.

2. A pair of pliers, as in claim 1, wherein said arced portion of said other side, and the adjacent side of said secondary pivot lug are toothed to secure a rigid connection when said secondary pivot lug engages said other side.

3. A pair of pliers, as in claim 1, wherein said arced portion of said other side and said secondary pivot lug are closer to said jaw portions than said first pivot bolt, to increase the mechanical advantage of said pliers when said fulcrum switches from said first pivot bolt to said secondary pivot lug.

4. A pair of pliers, as in claim 1, wherein said recess for accommodating said fixed pivot bolt ends in an inclined plane so that, as the pressure on said fixed pivot bolt deflects said spring, and said fixed pivot bolt is displaced from its recess, it must move up said incline in a direction to urge said pivot lug toward said other side until said pivot lug securely engages the adjacent sector of said arced portion.

5. A pair of pliers, as in claim 4, wherein said inclined plane becomes a plateau, after said pivot lug engages said other side, to permit additional motion of said fixed pivot, while said pivot lug remains locked in its position along said arced portion of said other side.

* * * * *